United States Patent [19]

Lyytinen

[11] Patent Number: 4,832,794

[45] Date of Patent: May 23, 1989

[54] METHOD AND APPARATUS FOR COMPENSATING DEFLECTION OF A LIP BEAM IN A PAPER MACHINE

[75] Inventor: Markku Lyytinen, Jyväskylä, Finland

[73] Assignee: Valmet Oy, Finland

[21] Appl. No.: 89,684

[22] Filed: Aug. 26, 1987

[30] Foreign Application Priority Data

Aug. 26, 1986 [FI] Finland ..... 863458

[51] Int. Cl.[4] ..... D21F 1/02

[52] U.S. Cl. ..... 162/198; 162/199; 162/262; 162/263; 162/336; 162/344

[58] Field of Search ..... 162/336–339, 162/344, 347, 198, 199, 262, 263

[56] References Cited

U.S. PATENT DOCUMENTS

| | | | |
|---|---|---|---|
| 3,468,756 | 9/1969 | Villa | 162/344 |
| 3,769,154 | 10/1973 | Wolf | 162/336 |
| 4,008,123 | 2/1977 | Kirjavainen | 162/336 |
| 4,455,197 | 6/1984 | Croteam et al. | 162/344 |
| 4,552,619 | 11/1985 | Laitinen et al. | 162/344 |

FOREIGN PATENT DOCUMENTS

| | | | |
|---|---|---|---|
| 849817 | 8/1970 | Canada | 162/336 |
| 1145229 | 3/1969 | United Kingdom | 162/336 |

*Primary Examiner*—Karen Hastings
*Attorney, Agent, or Firm*—Steinberg & Raskin

[57] ABSTRACT

Method and apparatus for compensating bending of a lip beam in a paper machine when papermaking pulp flowing through the slice formed with the lip beam causes loading upon a bottom surface of the top lip beam. The bending of the beam caused by the loading is compensated by bending the lip beam in the opposite direction, by creating a temperature difference in the lip beam between a top part and a bottom part of the same.

23 Claims, 2 Drawing Sheets

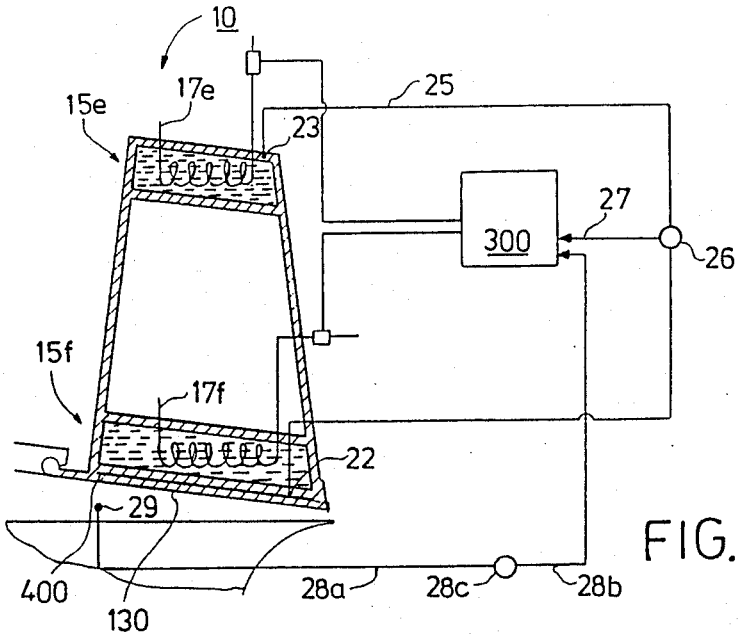
FIG. 4
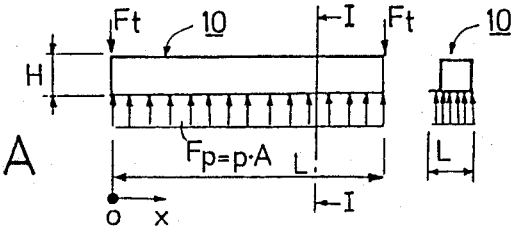
FIG. 5A
FIG. 5B
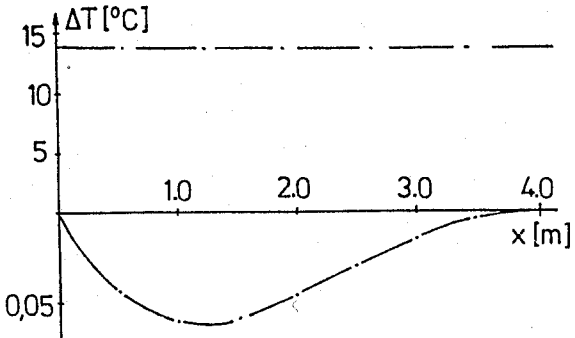
FIG. 6
FIG. 7

METHOD AND APPARATUS FOR COMPENSATING DEFLECTION OF A LIP BEAM IN A PAPER MACHINE

BACKGROUND OF THE INVENTION

The present invention relates to a method for compensating bending of a lip beam in a paper machine, when papermaking pulp flowing through a slice formed with the lip beam, causes loading upon the bottom surface of the top lip beam. The present invention also relates to apparatus in accordance with this method.

Reference is made to Finnish Pat. No. 50,156, corresponding to U.S. Pat. No. 4,008,123, as the state of the art, this reference describing loading of the front wall beam of a headbox of a paper machine or similar device, and particularly describing supporting intended to compensate for the temperature deflection. In this reference, the front wall beam is supported at least at two points, preferably at the so-called Bessel points, on the frame beam of the headbox.

According to this Finnish patent, in order to compensate for the deflection caused by the loading of the front wall beam and the temperature difference between the inner wall and the outer wall, adjustable power equipment has been arranged onto the ends of the front-wall beam. Although it is possible with the solution described in Finnish Pat. No. 50,156 to considerably reduce the bending of the top lip beam as compared to the situation when the beam is supported only at its so-called Bessel points, it is, in practice, not possible to achieve a sufficiently even slice with this solution.

Reference is also made to Finnish patent application No. 82-4439 as the state of the art, which relates to an arrangement in the supporting system of the top lip design in the headbox of a paper machine. In this arrangement, the shape variations of the top lip are compensated in such a manner that the width of the headbox slice will remain as constant as possible crosswise, or maintain a certain profile.

A new feature that has been considered in this Finnish patent application, is that the top lip beam is supported onto the frame beam or similar with a set of mechanical actuators, comprising several successive, crosswise actuators. Position transmitters have been arranged at these actuators, which measure the change of position perceived at each actuator. These position transmitters are connected to an electrical control circuit, with which the actuator set is controlled by means of regulating equipment, such as an hydraulic valve.

In the prior art, the headbox slice from which the stock spray is discharged onto the forming wire or into the forming gap, is fine-adjusted by means of a tip strip, to which several parallel adjusting shafts have been connected. With these adjusting shafts, the tip strip is so bent that the thickness profile of the lip spray is suitable, generally as even as possible. In order to make the adjusting of the lip spray possible, the tip strip must be movably supported onto its mating surface, usually onto the front wall of the top lip beam of the headbox.

SUMMARY OF THE INVENTION

Accordingly, it is an object of the present invention to improve control of the bending of a lip beam, i.e. a top lip beam, in the headbox of a papermaking machine.

It is also an object of the present invention to provide for such control of the lip beam bending in a sufficiently precise and quick manner.

It is another object of the present invention to provide for smooth, accurate control of the bending of the lip beam in the headbox with respect to pressure generated by flow of pulp stock through the slice in the headbox.

It is a further object of the present invention to improve control of the bending of the lip beam with respect to temperature variations in the headbox, and in the lip beam itself.

The pressure loading of the stock or stock suspension depends upon the speed of the paper machine. An object of the present invention is to provide such an arrangement with which slice shape variations caused by the pressure variations of the stock flow, may be controlled sufficiently quick and precisely.

These and other objects are attained by the present invention which is directed to a method for compensating bending of a lip beam of a paper machine when papermaking pulp stock flowing through a slice formed with the lip beam causes loading upon a surface of the lip beam. In particular, the method comprises the step of creating a temperature difference between a top part and a bottom part of the beam, whereby the lip beam is bent in a direction opposite to bending caused by the loading which is thereby compensated.

The present invention is also directed to apparatus for compensating deflection of a lip beam forming part of a slice in a paper machine through which pulp stock flows. The apparatus comprises means for creating a temperature difference between a top part and a bottom part of the beam, and thereby generating bending in an opposite direction to bending of the beam caused by loading of the pulp stock. In particular, this temperature difference creating means comprise at least one heating block situated in or upon the beam, and means for conveying thermal energy to the at least one heating block.

A principal characteristic of the present invention is that the bending of the beam caused by the loading, is compensated by bending the lip beam in the opposite direction, by creating a temperature difference between a top part and a bottom part of the lip beam. A principal characteristic of the apparatus for compensating the bending of the lip beam in accordance with the present invention, is that the lip beam comprises at least one heating block, to which thermal energy is conveyed, in order to create the desired temperature difference between the top part and the bottom part of the beam, so that an opposite-direction bending caused by the temperature differential compensates for the bending caused by the loading.

According to the invention, the top beam deflection due to loading is compensated by creating, in the top lip beam, a temperature difference between the top and bottom edges of the beam. This temperature difference causes a different thermal expansion in the top part and in the bottom part of the beam, which further bends the beam in the opposite direction from the loading. Therefore, with the method of the present invention and with the apparatus in accordance with the same, it is possible to maintain the slice between the top lip beam and the bottom lip beam as constant as possible over the entire width of the lip beam. In an arrangement in accordance with the present invention, tip strips or other similar, well-known arrangements can also be used, in order to compensate for small slice variations.

The temperature difference is created in the lip beam, in accordance with the present invention, by conveying a certain amount of thermal energy to the top part of the lip beam. According to the invention, the temperatures of the top edge and the bottom edge of the lip beam are measured, and a temperature difference signal is created in a heating control device or is sent to the heating control device. The thermal energy conveyed to the beam is controlled by means of the temperature difference signal, and thus by means of the temperature difference information and also by means of the top lip beam loading information.

The top lip beam is preferably designed to comprise several heating blocks, to each of which a different amount of thermal energy is conveyed. Therefore, according to the present invention, the anti-deflection profile of the beam may be shaped as desired, especially to correspond to the loading profile of the beam but in an opposite direction therefrom.

Thermal energy is conveyed in accordance with the present invention by a heating resistor to a thermal medium, preferably water, which is disposed to convey the energy especially to a top structure or location of the top lip beam.

BRIEF DESCRIPTION OF THE DRAWINGS

The present invention will now be described in greater detail with reference to certain advantageous embodiments illustrated in the accompanying drawings, to which the present invention is not intended to be restricted. In the drawings.

FIG. 4 is a side sectional view similar to FIG. 3 of another heating block arrangement in the top lip beam, also illustrating a crosssectional view of the beam;

FIGS. 5A and 5B illustrate symbols used in the calculation formulae in the present invention, with FIG. 5A being a side view of a beam structure in a loading situation, and FIG. 5B being a cross-sectional view of the beam of FIG. 5A in the direction of arrows I—I in FIG. 5A; and FIGS. 6 and 7 are graphical illustrations showing the results of a calculation example in accordance with the present invention, with FIG. 6 showing change of slice profile over a width of the slice when a temperature difference has compensated for change due to pressure load, which is constant in the direction of the length of the beam (this figure also showing the compensating temperature difference in question), and FIG. 7 showing temperature distribution required to maintain the slice profile straight for the slice design and pressure loading of FIGS. 5A and 5B when utilizing several temperature blocks over the length of the lip beam.

DESCRIPTION OF THE PREFERRED EMBODIMENTS

Figure 1:
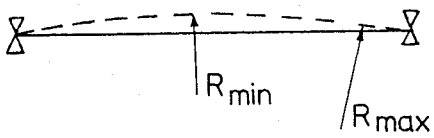
FIG. 1 is a schematic illustration with a continuous line showing the elasticity line of a beam before a pressure load affects the beam, and a dashed line illustrating deflection which a pressure load creates upon a top lip beam.

FIG. 1 illustrates the bending of the top lip beam caused by the pressure loading, with the length of the beam indicated by 1. The bending will be at its maximum in the middle of the beam, when the pressure loading is the same at each point of the entire length of the beam. However, the bending radius of the beam will be at minimum in the middle of the beam, and at a maximum at the ends of the beam structure. The deflection can be calculated with the following formula:

$$f_x = \frac{F_p\, l^3}{24\, EI} \cdot \frac{x}{l} \cdot \left( l - 2\frac{x^2}{l^2} + \frac{x^3}{l^3} \right)$$

In this formula, $F_p$ is the pressure load applied onto the beam, 1 is the length of the beam, E is the modulus of elasticity, I is the moment of inertia of the beam, and x is the variable denoting distance from the end of the beam. This formula gives the deflection of the beam at each point x.

According to the present invention, the beam deflection caused by the pressure load of the lip-channel stock flow, is compensated so that a temperature difference is created between the top edge and the bottom edge of the beam. When the temperatures at the top edge and the bottom edge of the beam are different, then the thermal expansion of these beam parts is also different with the result that the beam bends. When a higher amount of thermal energy is conveyed to the lower part of the beam, i.e. when the lower part of the beam is raised to a higher temperature than the top part of the beam, then the lower part tends to expand more than the top part of the beam, with a result that this temperature difference creates, in the beam, an opposite deflection with respect to the loading. Thus, the loading deflection is compensated. This temperature diffence causes a compensating deflection, in a direction opposite to the direction of deflection caused by the load itself.

If the temperature difference between the top edge and the bottom edge of the beam is selected to be constant in the direction of the width of the paper machine, then the beam will tend to bend in a constant-radius arc. By correctly selecting this temperature, it is possible to very precisely compensate for the change of the slice caused by the beam deflection. However, the result will not be flawless, because the bend shape caused by the pressure is not attained with this adjustment.

In a preferred embodiment of the present invention, the temperature difference between the top edge and the bottom edge of the beam is adjusted so that it varies in the direction of the width of the machine, and thus over the length of the lip beam. With such adjustment in accordance with the present invention, it is possible to attain deflection which has the same shape but in the opposite direction as compared to deflection caused by the pressure, with the result that the slice profile will remain straight.

Figure 2:
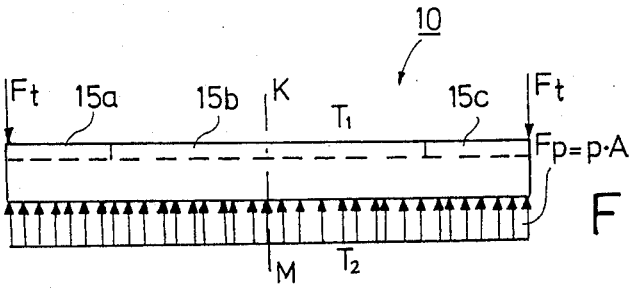
FIG. 2 is a schematic illustration of the loading components encountered on the lip beam, and of the method and apparatus in accordance with the present invention.

FIG. 2 schematically illustrates a side view of a lip beam in a loading situation. $T_1$ is room temperature, approximately 25° C., and $T_2$ is temperature of the stock which varies between 35° C. and 60° C. Therefore, the bottom edge of the beam will be warmer than the top edge of the beam. The stock creates a pressure load on the bottom edge of the beam, which tends to bend the beam in an arc as illustrated in FIG. 1. However, if the bottom edge of the beam, due to the thermal energy transferred from the stock, develops a higher temperature than the top edge of the beam bounded by room air, then the beam will bend in the opposite direction, which to a certain extent compensates for the deflection caused by the pressure load.

In order to provide the correct compensation for the deflection caused by the pressure load, it is necessary to create a certain predetermined temperature difference between the top edge and the bottom edge of the beam. The papermaking pulp, when flowing between the top lip and the bottom lip, causes a pressure on the top beam. This pressure load may be denoted by the formula $F_p = p \times A$, where p is the pressure of the stock flow, and A is the area of the lip beam bounded by the stock flow.

The lip beam is supported at its ends, with the support reactions or forces due to the loading at both ends being indicated by $F_t$. In order to provide as precise deflection compensation as possible, three heating blocks, namely blocks 15*a*, 15*b* and 15*c*, are longitudinally arranged on the lip beam. In the middle, a higher temperature difference is required between the top and bottom edges of the beam in order to compensate for the smaller-diameter deflection in the center area. Similarly, a lower temperature difference between the top and bottom edges of the beam is required in the end blocks 15*a* and 15*c*, as the need for deflection compensation is smaller. The lengthwise center-point of the beam is indicted by K.

Figure 3:
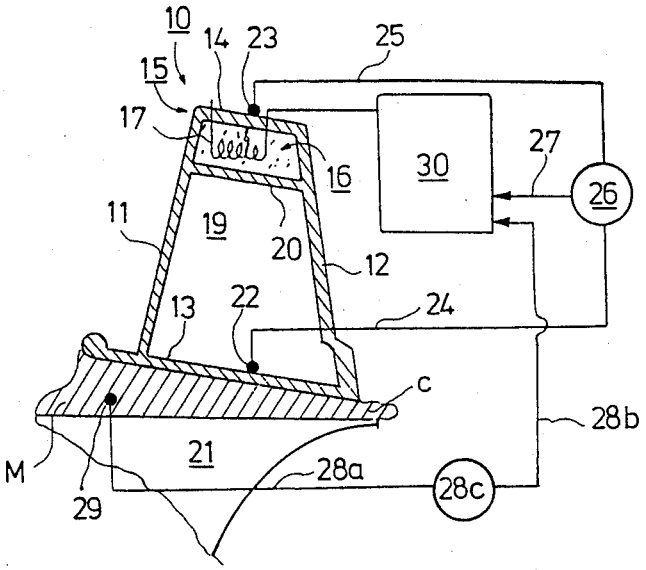
FIG. 3 is a side sectional view of the apparatus in accordance with the present invention, illustrating a cross-sectional view of the lip beam.

FIG. 3 illustrates a cross-section of a lip beam 10. This figure illustrates the heating block 15 as comprising a medium space or compartment 16, into which a heating element, e.g. resistor 17, is installed. The heat transfer medium situated in the medium space 16 is advantageously liquid, and preferably water 18. The medium space 16 is arranged to be located at the top edge of the lip beam 10. The lip beam 10 is advantageously a box beam. A central box space 19 is situated between side plates 11, 12, and bottom plate 13 and top plate 14 of this beam. A connecting plate 20, bounded by the central space 19, is arranged between the side plates 11 and 12 of the beam, with the medium space or compartment 16 being formed in the space between the connector plate 20, the adjacent sections of the side plates 11 and 12, and the top plate 14 as illustrated in FIG. 3.

The papermaking pulp, which is denoted by M in FIG. 3, is disposed to flow in the gap indicated by C between the top lip beam 10 and the bottom lip 21. This gap C is important from the point of view of the quality of the paper. More particularly, the important point is that the width of the gap must be kept as constant as possible over the entire length of the beam.

In the method and apparatus in accordance with the present invention, the temperature difference between the top edge and the bottom edge of the beam is measured. One measuring sensor 22 is advantageously arranged to be located within the central box space 19 of the beam 10, preferably close to the bottom plate 13, and preferably arranged on the inner surface of the bottom plate 13 as illustrated in FIG. 3. The other measuring sensor 23 is arranged to be located close to the top plate 14, preferably on its outer or cover surface. Temperature information is conducted from the measuring sensor 22 via a signal way 24 and from the measuring sensor 23 via a signal way 25, to a calculating device 26 which gives the difference of the temperatures measured by the measuring sensors 22 and 23. This temperature difference signal is conducted via the signal way 27 to a heating control device 30.

In addition to the temperature difference signal, a signal showing loading of the beam 10 is also brought to the control device 30 along a connector 28*a,b*. The loading effect by the stock flow M against the beam 10 is measured with a pressure sensor 29 located at the lip part C or near the same. This information/signal is conveyed either directly, or through an intermediate unit 28*c*, to the heating control device 30 which is disposed to directly analyze this signal 29 conveyed from the transmitter sensor 29. The heating control device 30 converts the measuring signals of the sensor quantity directly into the information mode required by the temperature control unit 30.

The required ΔT-profile or the temperature difference profile can be calculated for each pressure load, which also depends on the speed of the flowing stock. By adjusting the power of the heating resistor by measuring the force created by the paper pulp flow on the bottom surface of the lip beam 10 and ΔT, the compensation will be as precise as possible. The heating control device 30 is adjusted to provide a desired amount of heating power to the heating resistor 17 or similar device providing heating energy, and to each heating block 15*a*, 15*b*, and 15*c*. The force caused on the lip beam by the loading can be measured, for instance from the pressure of the stock flow by means of the pressure sensor 29.

FIG. 4 illustrates a cross-section of another lip beam 10. In the embodiment illustrated in this figure, in order to provide correct temperature differential between the top and bottom edges of the beam, each edge is equipped with its own heating block 15*e* or 15*f*. In this embodiment, the heating control device 300 adjusts the temperature of each heating block 15*e* and 15*f*. In other words, the thermal energy is brought to both the heating elements 17*e* and 17*f*. In order to keep the temperature difference between the top part and the bottom part of the beam as constant as possible, a heat convection insulation 400 is arranged on the top lip beam between its top part and its bottom part. As illustrated in FIG. 4, the insulation 400 may advantageously be an air gap arranged below the heating block 15*f* in the middle range of the bottom wall 130 of the heating block. Thus, the convection of heat to the beam structure is prevented. This also prevents convection of heat from the heating element 17*f* through the wall 130 into the stock flow, which would carry thermal energy away.

Thus, as shown in FIG. 4, the correct beam deflection is provided by adjusting both the element 15*e* and the element 15*f* and the thermal energy brought to the same. Such adjustment is made by the heating control device 300 which receives the information of the loading caused by the stock flow from the pressure sensor 29, and the temperature information from the sensors 23 and 22. Other elements and features similar to those of FIG. 3 are denoted by like reference numerals.

FIGS. 5A and 5B show the meaning of symbols used in the following calculation example. More particularly, FIG. 5A is a side view of the top beam 10. The length of the beam is indicated by 1, and the height of the beam is indicated by H. The end support reaction or force is indicated by $F_t$. The pressure of the lip channel is denoted by p, with the bottom area of the lip beam being indicated by A. The pressure load is $F_p = p\ A$, with the distance from the end of the beam being indicated by x. FIG. 5B illustrates the cross-section of the beam, with the length of the side being denoted by L and the height by H.

EXAMPLE

In the following example,
v (flow of stock)=900 m/min,
p=112.5 kPa,
l=8000 mm,
L=700 mm, and
H=1000 mm.

A calculation for determining the correct temperature difference between the top and bottom edges of the beam has been performed with the above values. The following formulae have been used in the calculation, for a beam supported at its ends. More particularly, the displacement $f_{x1}$ caused by the pressure load is denoted by the formula $$f_{x1} = y = \frac{F_p\, l^3}{24\, EI}\ \frac{x}{l}\left(l - 2\left(\frac{x}{l}\right)^2 + \left(\frac{x}{l}\right)^3\right) \text{elasticity line,}$$

with the derivatives of this elasticity line being $$y' = \frac{F_p\, l^2}{24\, EI}\left(l - 6\left(\frac{x}{l}\right)^2 + 4\left(\frac{x}{l}\right)^3\right), \text{ the first}$$

derivative, and $$y'' = \frac{F_p}{2\, EI}\left(\frac{x^2}{l} - x\right), \text{ the second derivative.}$$

by the formula $$R_x = \frac{\sqrt{(1 + y'^2)^3}}{y''}$$

With temperature difference required for the same deflection being denoted by the formula $$\Delta\, T_x = \frac{l}{\alpha}\left(\frac{R_x + H/2}{R_x - H/2} - 1\right)$$

The largest displacement due to pressure load is denoted by the formula:

$$f_{max} = \frac{5}{384}\ \frac{F_p\, l^3}{E3}$$

with the radius of curvature with which the center and the ends of the beam are at the same line being denoted by the formula $$R = \frac{f_{max}^2 + \left(\frac{1}{2}\right)^2}{2\, f_{max}}$$

$F_p$=pressure load=p×A
E=modulus of elasticity
I=moment of inertia of the beam
l=length of the beam
α=coefficient of thermal expansion
H=height of the beam The results of the calculation for the above-values are presented in Table I:

TABLE 1

| x (m) | $f_{x1}$ (mm) | $f_{x2}$ (mm) | Δb (mm) | $R_x$ (km) | $\Delta T_x$ (C.°) |
|---|---|---|---|---|---|
| 0 | 0 | 0 | 0 | 00 | 0 |
| 0.5 | 0.3764 | −0.4447 | −0.0683 | 15.001 | 3.91 |
| 1.0 | 0.7363 | −0.8299 | −0.0936 | 8.036 | 7.31 |
| 1.5 | 1.0652 | −1.1556 | −0.0904 | 5.769 | 10.19 |
| 2.0 | 1.3511 | −1.4222 | −0.0719 | 4.688 | 12.55 |
| 2.5 | 1.5837 | −1.6300 | −0.0461 | 4.091 | 14.38 |
| 3.0 | 1.7555 | −1.7999 | −0.0223 | 3.750 | 15.68 |
| 3.5 | 1.8608 | −1.8669 | −0.0061 | 3.571 | 16.47 |
| 4.0 | 1.8962 | −1.8964 | −0.0002 | 3.516 | 16.73 |

x = distance of the calculation point from the end of the beam,
$f_{x1}$ = displacement due to the pressure load,
$f_{x2}$ = displacement of compensation created by even temperature difference distribution ΔT = 13.9°,
Δb = error left in the lip profile from compensation created with even temperature difference distribution (Δb = $f_{x1}$ + $f_{x2}$),
$R_x$ = radius of curvature caused by the pressure load,
$\Delta T_x$ = temperature difference, with which the slice profile remains faultless (FIG. 7).

FIG. 6 is a graphical illustration of the change of the slice profile over the width of the slice, when the change caused by the pressure load has been compensated with a temperature difference which is constant in the direction of the length of the beam when the temperature difference ΔT between the top edge and the bottom edge of the beam is 13.9° C. The table shows that the ends and the center of the beam are essentially on the same line, but some error is left in the profile of the slice (Δb).

FIG. 7 is a graphical illustration of the temperature distribution required to maintain the slice profile straight. The temperature difference $\Delta T_x$ ($\Delta T_x = T_{bottom\ edge} - T_{top\ edge}$) required for the length of the lip beam, is different in the direction of the length of the lip beam. FIG. 7 graphically illustrates the temperature differences required for compensation of the pressure load, so that the slice profile would remain straight (corresponding to Table I). It is seen in the curve of the figure, that the maximum temperature difference is required in the middle range of the width of the beam. In a run in accordance with the embodiment of Table 1, i.e. with the corresponding dimensions of the lip beam and the stock speed v of the presentation of this Table, the required optimum temperature difference in the center range of the beam is 16.73° C.

Considerably smaller temperature differences are required near the beam ends, i.e. near the beam support points. For instance, in an embodiment of Table 1, the optimum temperature difference is approximately 3.91° at a distance of 0.5 m from the support point. According to the present invention, the various temperature differences are created in the beam at its different points, using several different temperature blocks over the length of the beam. The compensation will be very precise if the beam is divided into more and more heating block ranges, where different amounts of thermal energy are brought to each block in order to create the desired temperature difference at each point of the beam.

The preceding description of the present invention is merely exemplary, and is not intended to limit the scope thereof in any way.

I claim:

1. Method for compensating bending of a lip beam of a paper machine when papermaking pulp stock flowing through a slice formed with the lip beam causes loading upon a surface of the lip beam, comprising the steps of creating a temperature difference between a top part and a bottom part of the beam, whereby the lip beam is bent in a direction opposite to bending caused by the loading which is thereby compensated, measuring pressure of the flowing pulp stock at or near the lip beam, adjusting temperature difference between the top and bottom parts of the lip beam based upon the measured pressure, and adjusting the temperature difference over a length of the lip beam by supplying different amounts of thermal energy to different points of the lip beam in order to provide desired bending compensation by providing a plurality of heating blocks along the length of the beam, and conveying the thermal energy to each said heating block independently from any other heating block by providing heat transfer medium within a compartment in each said heating block, and transferring the thermal energy to the heat transfer medium from a heating element situated in each said compartment in each said heating block.

2. The method of claim 1, comprising the additional step of determining the temperature difference required for compensation based upon loading caused by the flowing pulp stock against a bottom edge of the lip beam.

3. The method of claim 1, comprising the additional step of measuring the temperature difference between the bottom and top parts with at least two temperature sensors, one of which is arranged at a bottom edge of the lip beam and the other of which is arranged at a top edge of the lip beam.

4. The method of claim 3, comprising the additional steps of sensing the pressure of the flowing pulp stock with a pressure sensor positioned in or near the flowing pulp stock, and adjusting the temperature difference based upon the measured temperature difference and the sensed pressure.

5. The method of claim 1, wherein each said heating element is a heating resistor arranged in each said compartment of the beam blocks that are filled with the heat transfer medium.

6. The method of claim 5, wherein the heat transfer medium is water.

7. The method of claim 5, wherein the temperature differential is created by additionally activating at least one heating resistor arranged in a bottom compartment of the beam that is filled with heat transfer medium and is arranged on said beam on a side opposite said plurality of blocks.

8. The method of claim 1, wherein three separate compartments are provided along the length of said beam.

9. The method of claim 1, comprising the additional step of maintaining width of a gap between said lip beam which is a top lip beam and a bottom lip beam as constant as possible over an entire length of said top lip beam.

10. The method of claim 1, comprising the additional step of determining the temperature difference $\Delta T_x$ required for compensation at a particular point x along the beam, by the following formula $$\Delta T_x = \frac{l}{\alpha}\left(\frac{R_x + H/2}{R_x - H/2} - 1\right)$$

wherein $\alpha$=coefficient of thermal expansion of the beam,

H=height of the beam, and $R_x$=radius of curvature due to the pressure load at the particular point x.

11. The method of claim 10, comprising the additional step of determining $R_x$ by the following formula $$R_x = \frac{\sqrt{(1 + y'^2)^3}}{y''}$$

wherein y' and y'' are respectively first and second derivatives of the formula $$\frac{F_p\, l^3}{24\, EI}\ \frac{x}{l}\left(l - \frac{2x^2}{l^2} + \frac{x^3}{l^3}\right)$$

wherein $F_p$=pressure load,

E=modulus of elasticity of the beam,

I=moment of inertia of the beam, and l=length of the beam.

12. The method of claim 1, comprising the additional steps of providing said plurality of heating blocks on the top part of said lip beam and providing a plurality of heating blocks on the bottom part of the beam opposite said top heating blocks, and conveying the thermal energy to each of said bottom heating blocks independently from any other heating block by providing heat transfer medium within a compartment in each said bottom heating block and transferring the thermal energy to the heat transfer medium from a heating element situated in each said compartment in each said bottom heating block.

13. In the head box of a paper making machine with a slice lip beam, apparatus for compensating deflection of said lip beam forming part of said slice in said paper making machine through which pulp stock flows, comprising means for creating a temperature difference profile between a top part and a bottom part of said beam over a length thereof, and thereby generating bending in an opposite direction to bending of said beam caused by loading of the pulp stock, and a pressure sensor for sensing loading on the beam by the flowing pulp stock, and coupled to said temperature difference creating means, wherein said temperature difference creating means comprise a plurality of heating blocks arranged along the length of the beam, and means for conveying thermal energy to each said heating block independently from any other heating block, wherein each said heating block comprises a compartment therewithin, filled with heat transfer medium, and said conveying means comprise a heating element situated within each said compartment, whereby the thermal energy is transferred from each said heating element through the medium to said lip beam.

14. The apparatus of claim 13, wherein each said heating element is a heating resistor and the medium is water.

15. The apparatus of claim 13, wherein each said heating block is situated on the top part of said lip beam.

16. The apparatus of claim 15, additionally comprising at least two temperature sensors, one of which is situated at the top part of the beam and the other of which is situated at the bottom part of the beam, a calculator connected to both said temperature sensors, for generating a control signal based on the temperature sensed by said sensors, and a heating control device connected to said heating blocks and to said calculator, for receiving the control signal from said calculator and adjusting conveying of the thermal energy to said heating block.

17. The apparatus of claim 16, wherein said pressure sensor is connected to said heating control device which also adjusts the conveying of the thermal energy in response to pressure sensed by said pressure sensor.

18. The apparatus of claim 15, additionally comprising a plurality of heating blocks situated on a bottom part of the beam opposite said top heating blocks, said bottom heating blocks also each comprising a compartment filled with heat transfer medium and said conveying means also comprise a heating element situated within each said compartment of each said bottom heating block.

19. The apparatus of claim 18, additionally comprising heat convection insulation situated upon the beam for maintaining the temperature differential between the top and bottom parts of the beam as constant as possible.

20. The apparatus of claim 18, wherein each said heating element is a heating resistor and the medium is water.

21. The apparatus of claim 13, wherein said pressure sensor is mounted at or near a bottom edge of said lip beam which is situated above the pulp stock flow.

22. The apparatus of claim 13, additionally comprising three of said heating blocks longitudinally arranged along said beam.

23. The apparatus of claim 13, wherein said beam is a top lip beam and defines a gap between the same and a bottom lip beam, and width of said gap is maintained as constant as possible over an entire length of said top lip beam.

* * * * *